US008103195B2

(12) United States Patent
Yoshida et al.

(10) Patent No.: US 8,103,195 B2
(45) Date of Patent: Jan. 24, 2012

(54) TONER AGITATING UNIT, TONER HOPPER, PROCESS CARTRIDGE, AND IMAGE FORMING APPARATUS

(75) Inventors: Tomofumi Yoshida, Osaka (JP); Hirobumi Ooyoshi, Osaka (JP); Kenzo Tatsumi, Osaka (JP); Yoshihiro Kawakami, Hyogo (JP); Yoshiyuki Shimizu, Hyogo (JP); Tomohiro Kubota, Osaka (JP); Yutaka Naitoh, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 504 days.

(21) Appl. No.: 12/332,545

(22) Filed: Dec. 11, 2008

(65) Prior Publication Data

US 2009/0162101 A1 Jun. 25, 2009

(30) Foreign Application Priority Data

Dec. 20, 2007 (JP) ..... 2007-328338
Oct. 10, 2008 (JP) ..... 2008-263326

(51) Int. Cl.
*G03G 15/08* (2006.01)

(52) U.S. Cl. ..... 399/256

(58) Field of Classification Search ..... 399/254, 399/256, 263
See application file for complete search history.

(56) References Cited

U.S. PATENT DOCUMENTS 6,246,854 B1 6/2001 Kurosawa et al.
7,873,308 B2 * 1/2011 Saito et al. ..... 399/263
2007/0104523 A1 5/2007 Yoshida et al.
2007/0140763 A1 6/2007 Shimizu et al.
2007/0196135 A1 8/2007 Fukuta
2007/0248390 A1 10/2007 Kubota et al.
2007/0264051 A1 11/2007 Tanaka
2008/0019720 A1 1/2008 Kawakami et al.
2008/0089727 A1 4/2008 Shimizu et al.
2008/0095559 A1 4/2008 Shimizu et al.
2008/0145108 A1 6/2008 Yoshida et al.
2008/0145109 A1 6/2008 Murayama et al.
2008/0145119 A1 6/2008 Tatsumi et al.
2008/0152408 A1 6/2008 Kawakami et al.
2008/0170898 A1 7/2008 Shimizu et al.
2008/0181692 A1 7/2008 Tatsumi et al.
2008/0187358 A1 8/2008 Kubota et al.
2008/0205930 A1 8/2008 Kawakami et al.
2008/0219698 A1 9/2008 Shimizu et al.
2008/0267661 A1 10/2008 Yoshida et al.
2008/0279586 A1 11/2008 Tatsumi et al.

FOREIGN PATENT DOCUMENTS

CN 101071287 11/2007
JP 10-301377 11/1998
JP 2001-318517 11/2001
JP 2001-318518 11/2001
JP 2002-268343 9/2002
JP 2005-134694 5/2005
JP 2007-199527 8/2007

OTHER PUBLICATIONS

Chinese Office Action dated Jul. 7, 2010 w/English Translation.

* cited by examiner

*Primary Examiner* — David Gray
*Assistant Examiner* — Gregory H Curran
(74) *Attorney, Agent, or Firm* — Dickstein Shapiro LLP

(57) ABSTRACT

A toner agitating unit is located in a toner hopper that houses toner used for developing a latent image. The toner agitating unit includes a rotary shaft and an agitating member. The agitating member is a flat plate made of resin. The agitating member has a plurality of slits extending from an outer edge of the agitating member toward the rotary shaft.

8 Claims, 11 Drawing Sheets

TONER AGITATING UNIT, TONER HOPPER, PROCESS CARTRIDGE, AND IMAGE FORMING APPARATUS

CROSS-REFERENCE TO RELATED APPLICATIONS

The present application claims priority to and incorporates by reference the entire contents of Japanese priority document 2007-328338 filed in Japan on Dec. 20, 2007 and Japanese priority document 2008-263326 filed in Japan on Oct. 10, 2008.

BACKGROUND OF THE INVENTION

1. Field of the Invention

The present invention relates to a technology for agitating toner in a toner hopper of an image forming apparatus.

2. Description of the Related Art

A typical developing unit of an image forming apparatus includes a toner hopper that houses developing toner. The toner hopper incorporates a toner agitating unit that agitates toner that is to be supplied to a developing roller so that toner is uniformly and constantly supplied to the developing roller.

A toner agitating unit is disclosed in Japanese Patent Application Laid-open No. 2001-318517. This agitating unit includes a flexible agitating member attached to a rotary shaft. To improve agitation efficiency, the agitating member has a shape that causes the agitating member to experience a high drag from toner during agitation. More specifically, the agitating member has the shape of a flat plate (see FIG. 2 of Japanese Patent Application Laid-open No. 2001-318517).

However, because the agitating member has the shape of a flat plate, toner flows from a center portion of the agitating member toward its end portions when the agitating unit agitates the toner so that stress is likely to concentrate on the end portions of the agitating member. Such stress concentration may result in local plastic deformation of the agitating member, and repeated stress may cause damage to the agitating member.

SUMMARY OF THE INVENTION

It is an object of the present invention to at least partially solve the problems in the conventional technology.

According to an aspect of the present invention, there is provided a toner agitating unit that is arranged inside a toner hopper that houses toner to be used for developing a latent image and is operative to agitate the toner. The toner agitating unit includes a rotary shaft extending in a longitudinal direction; and an agitating member that is attached to the shaft and rotates with the shaft. The agitating member is made of resin, and the agitating member has a plurality of slits extending from an outer edge of the agitating member toward the rotary shaft.

According to another aspect of the present invention, there is provided a toner hopper that houses toner to be used for developing a latent image. The toner hopper includes a housing that houses the toner; and a toner agitating unit that is rotatably supported inside the housing and operative to agitate the toner in the housing. The toner agitating unit includes a rotary shaft extending in a longitudinal direction; and an agitating member that is attached to the shaft and rotates with the shaft. The agitating member is made of resin, and the agitating member has a plurality of slits extending from an outer edge of the agitating member toward the rotary shaft.

According to still another aspect of the present invention, there is provided an image forming apparatus comprising a toner hopper that houses toner to be used for developing a latent image. The toner hopper includes a housing that houses the toner; and a toner agitating unit that is rotatably supported inside the housing and operative to agitate the toner in the housing. The toner agitating unit includes a rotary shaft extending in a longitudinal direction; and an agitating member that is attached to the shaft and rotates with the shaft. The agitating member is made of resin, and the agitating member has a plurality of slits extending from an outer edge of the agitating member toward the rotary shaft.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
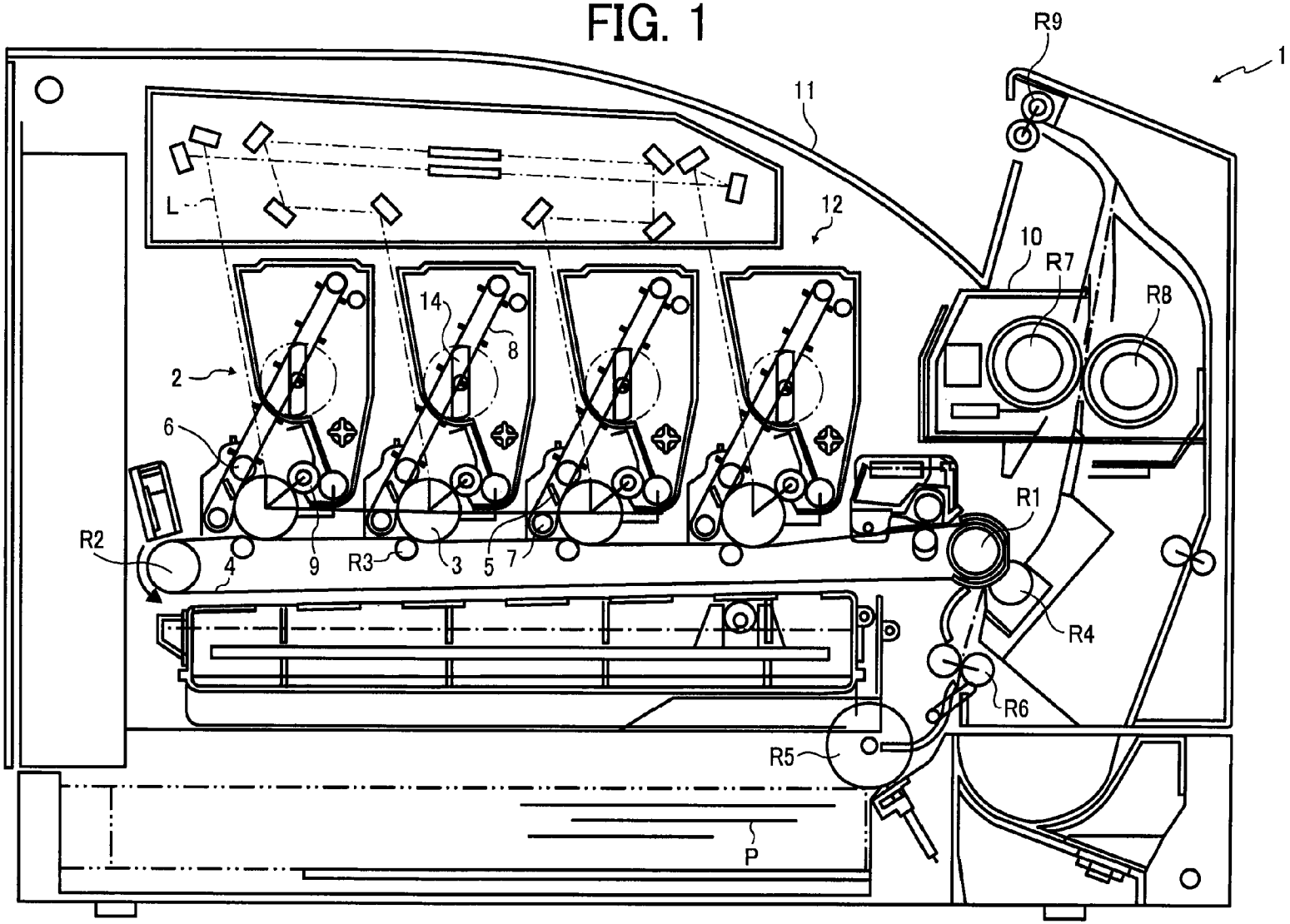
FIG. 1 is a schematic diagram of an image forming apparatus according to a first embodiment of the present invention.

FIG. 1 is a schematic diagram of an image forming apparatus 1 including a toner agitating unit 14 according to a first embodiment of the present invention. The image forming apparatus 1 includes four developing units 12, four image carriers 3, an intermediate transfer belt 4, and a fixing unit 10. Meanwhile, the number of the developing units 12 and the image carriers 3 is not limited to four.

Each of the developing unit 12 includes a developing device 2 that houses a toner of a corresponding color. Specifically, the developing devices 2 house toners of different colors: cyan (C), magenta (M), yellow (Y), and black (K). Each of the image carriers 3 is adjacent to a corresponding one of the developing devices 2. The intermediate transfer belt 4 is a medium by way of which a toner image is to be transferred. The intermediate transfer belt 4, which is an endless belt, is wound around a drive roller R1, a driven roller R2, and a primary transfer roller R3. A charging roller 6, a developing roller 9, and a cleaning unit 5 are arranged on a circumferential surface of the image carrier 3. The cleaning unit 5 collects residual toner on the image carrier 3 after a toner image has been transferred from the image carrier 3 to the intermediate transfer belt 4. The collected toner is conveyed (in the horizontal direction in this example) by a toner conveying screw 7 and a toner conveying belt 8 to a waste-toner container (not shown) to be housed in the waste-toner container.

How a four-color toner image is formed on the intermediate transfer belt 4 will be described below. As preparation for forming of the toner image, a voltage is applied from a bias supply (not shown) to a metal core of the developing roller 9, to which toner has been applied, and the charging roller 6. When applying the voltage, the image carrier 3 is rotated at a constant velocity. The cleaning unit 5 collects residual toner that is the toner that is left behind on the image carrier after image transfer. The charging roller 6 is arranged downstream of the cleaning unit 5 in a rotating direction of the image carrier 3 and it uniformly electrically charges and initializes the image carrier 3 to a high electric potential. Further downstream of the charging roller 6, the image carrier 3 is exposed to laser beams L. Specifically, the uniformly charged surface of the image carrier 3 is selectively exposed to light beams according to image data. As a result, portions having different electric potential are formed on the surface of the image carrier 3. Specifically, electric potential in the portions that are exposed to the light beams attenuates to a relatively low electric potential, and electric potential in the portions that are not exposed have the original relatively high potential. In short, a latent image is formed on the image carrier 3. Further downstream from the exposing position, toner present on the developing roller 9 is attracted toward the low electric-potential portions or the high electric-potential portions on the image carrier 3. In other words, a toner image is formed on the image carrier 3. The toner image is then transferred onto the intermediate transfer belt 4.

Timed with the transfer of the toner image to the intermediate transfer belt 4, the developing unit 12 develops the latent image present on the image carrier 3 into a visible image. This procedure is repeated for each of the colors until a composite four-color toner image is formed on the intermediate transfer belt 4. The four-color toner image is conveyed on and by rotation of the intermediate transfer belt 4 to a secondary transfer roller R4, which is arranged to face the roller R1. The secondary transfer roller R4 transfers the four-color toner image onto a recording medium P having been fed into the image forming apparatus 1 from an external sheet feeder by a paper feed roller R5 and delivered to the secondary transfer roller R4 by a pair of conveying rollers R6. The recording medium P with the four-color toner image passes through a nip between a fixing roller R7 and a pressing roller R8 in the fixing unit 10. The recording medium P is ejected by a pair of paper discharge rollers R9 of a paper discharge unit 11. The paper discharge unit 11 is arranged in an upper portion of the image forming apparatus 1. As in the case of the image carrier 3, residual toner that is the toner that remains on the intermediate transfer belt 4 after transfer is cleaned by a cleaning blade that comes into contact with the intermediate transfer belt 4.

Figure 2:
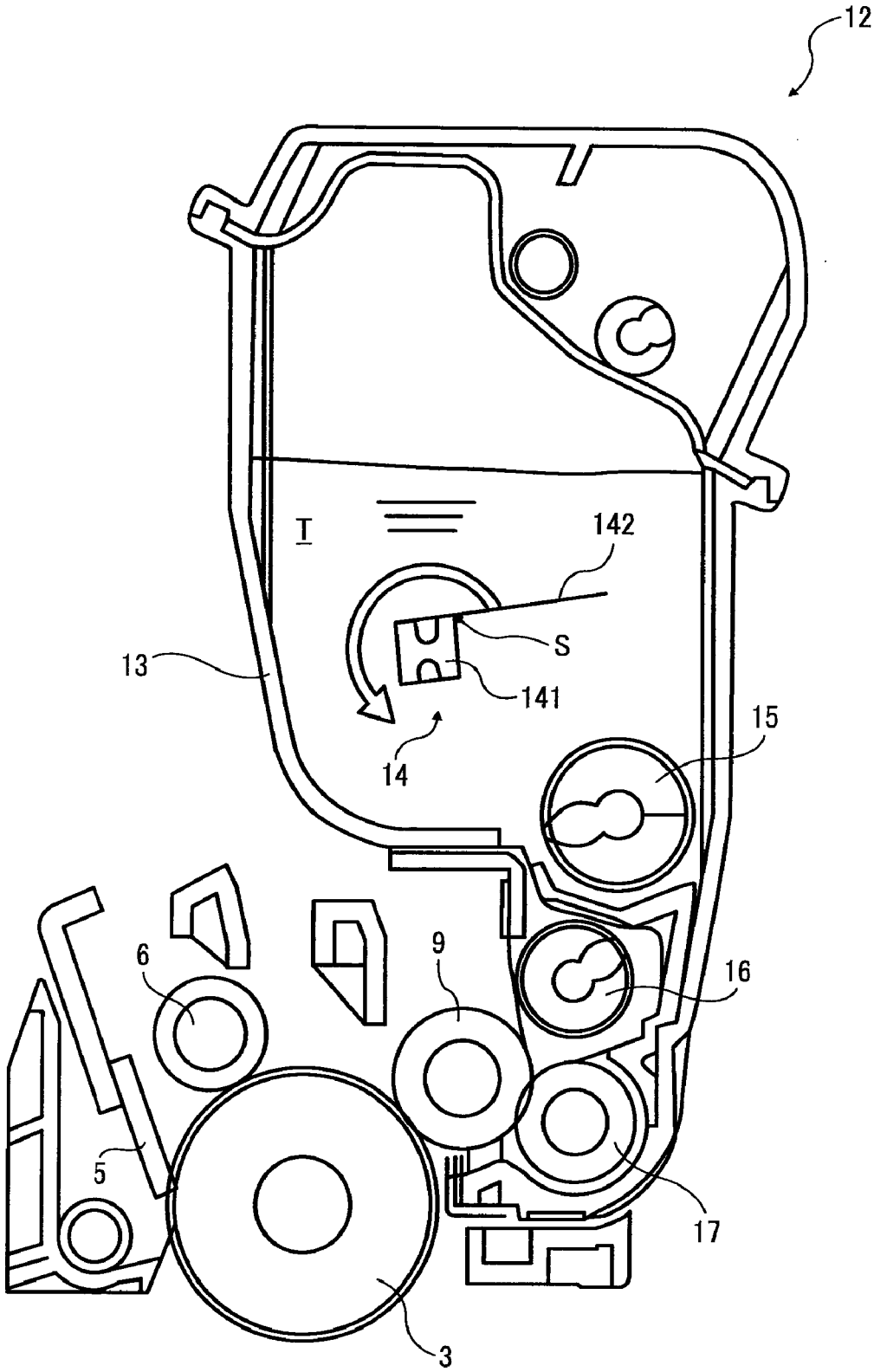
FIG. 2 is a schematic diagram of a developing unit shown in FIG. 1.

FIG. 2 is a schematic diagram of an arbitrary one of the four developing units 12, with the toner conveying belt 8 omitted. The developing unit 12 is a process cartridge that includes the image carrier 3 and the developing roller 9.

The developing unit 12 has a toner hopper 13 that houses toner T for use in developing. The toner hopper 13 incorporates the toner agitating unit 14. The toner agitating unit 14 includes a rotary shaft 141 and an agitating member 142 fixed to the rotary shaft 141. The agitating member 142 can be fixed to the rotary shaft 141 by a known method, e.g., affixing with a double-faced adhesive tape, thermal welding, or ultrasonic welding. The rotary shaft 141 is fixed to the agitating member 142 at a joint S. The agitating member 142 is a flat plate. Each of the rotary shaft 141 and the agitating member 142 is preferably made of resin such as polystyrene or acrylonitrile butadiene styrene resin.

The developing unit 12 includes toner conveying screws 15 and 16 that convey toner, and a toner supply roller 17. The toner supply roller 17 supplies toner to the developing roller 9.

Figure 3:
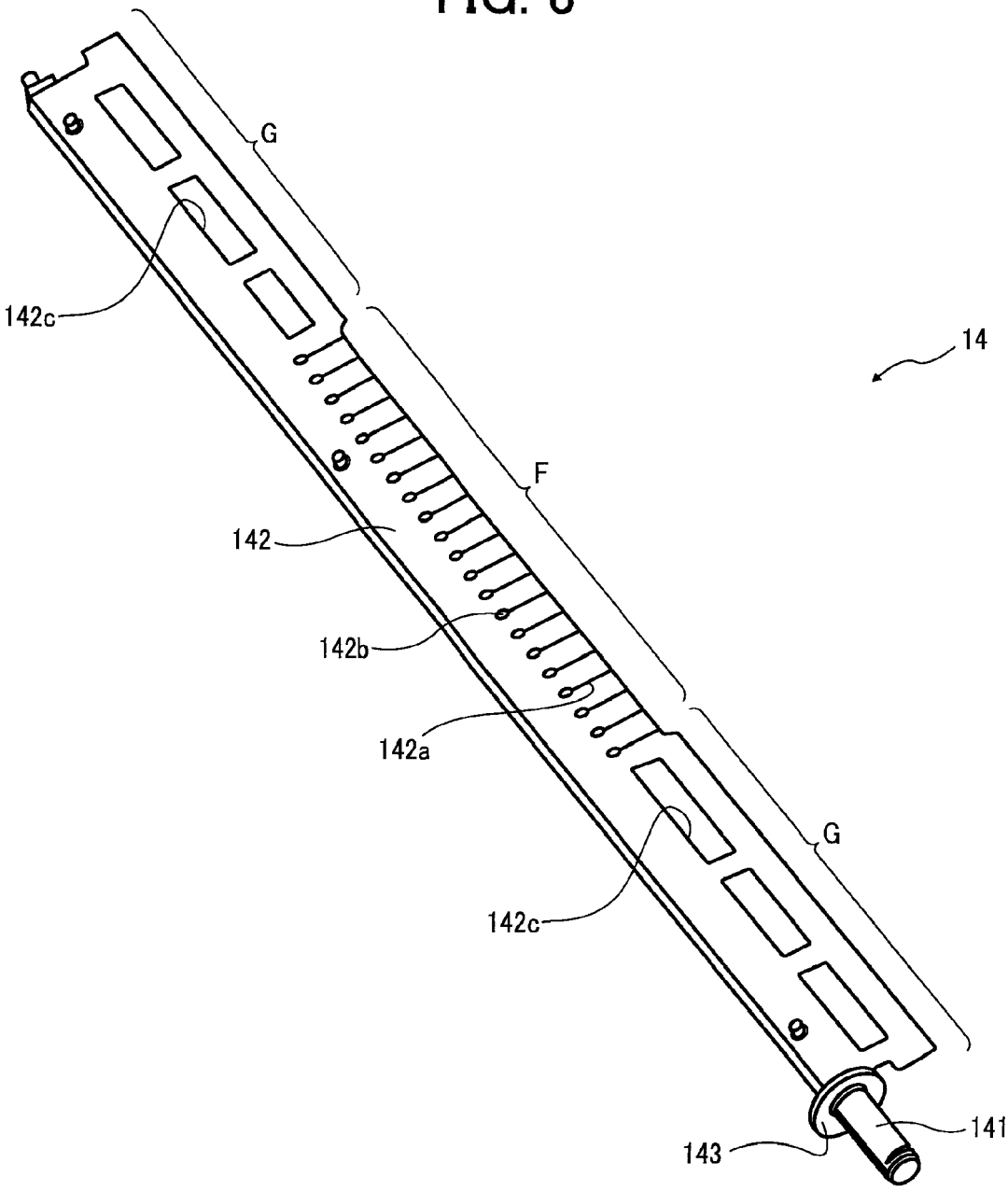
FIG. 3 is an enlarged perspective view of a toner agitating unit shown in FIG. 2.

FIG. 3 is an enlarged perspective view of the toner agitating unit 14. The toner agitating unit 14 has a plurality of slits 142*a* extending from an outer edge of the agitating member 142 toward the rotary shaft 141 (hereinafter, "first direction"). The first direction is substantially perpendicular to a longitudinal direction of the rotary shaft 141. The agitating member 142 includes a first section F, second sections G, through holes 142*b*, and a collar 143. While the first section F has the slits 142*a*, no slit is formed in the second sections G. The first section F is placed between the second sections G. The slits 142*a* can be made during the course of injection molding of the agitating member 142. Alternatively, the slits 142*a* can be made by machining the agitating member 142 after the agitating member 142 is formed with injection molding. The second section G has a plurality of elongated holes 142*c*, which are generally rectangular in cross section. The elongated holes 142*c* function to reduce the drag on the toner agitating unit 14 from toner during agitation so that the toner agitating unit 14 can rotate at a relatively high speed.

Figure 4:
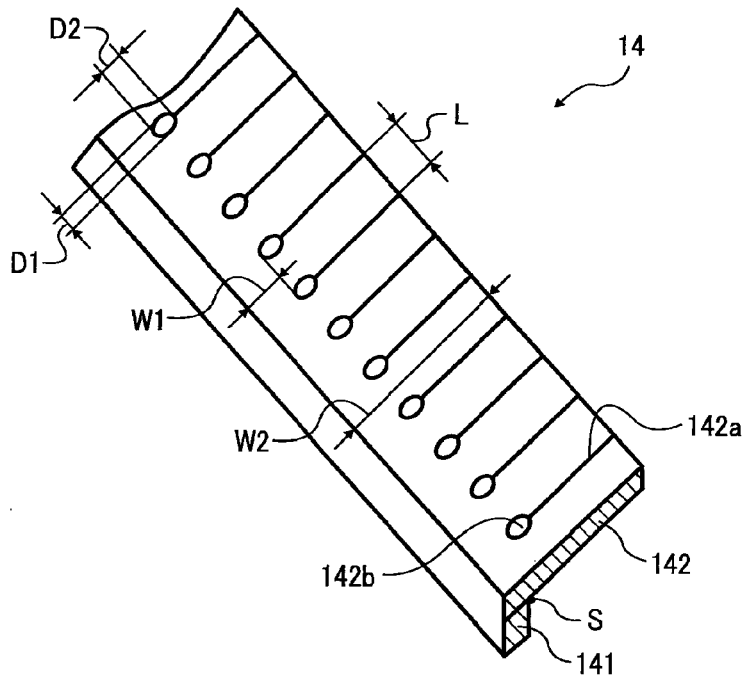
FIG. 4 is a schematic diagram of relevant parts of the toner agitating unit shown in FIG. 3.
Figure 5:
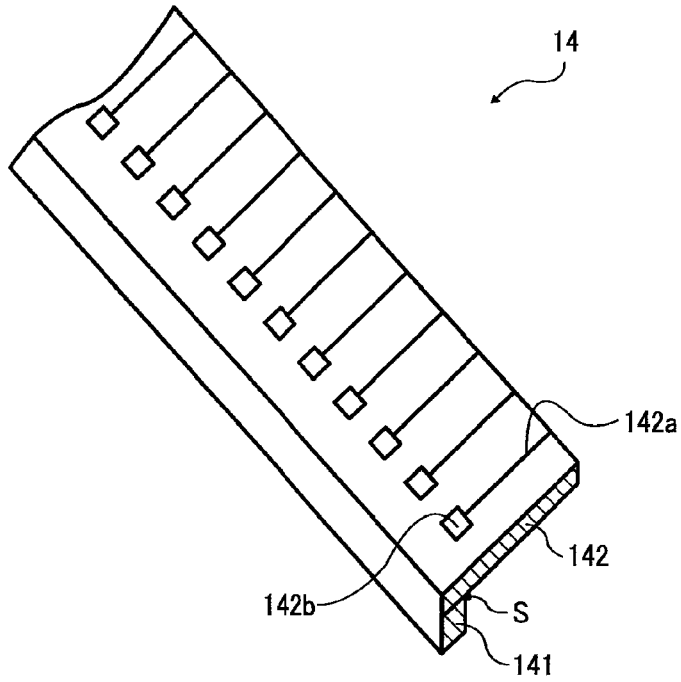
FIG. 5 is a schematic diagram of a first modification of the toner agitating unit shown in FIG. 4.
Figure 6:
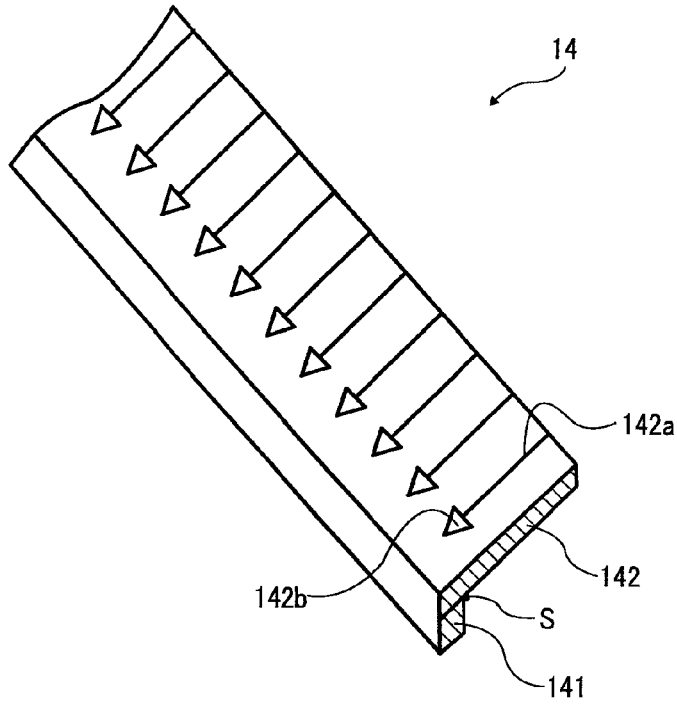
FIG. 6 is a schematic diagram of a second modification of the toner agitating unit shown in FIG. 4.

FIG. 4 is an enlarged perspective view of the first section F of the toner agitating unit 14. The first section F has a comb-like shape. The slits 142*a* extend in the first direction from an outer edge of the agitating member 142 to a portion near the joint S (see FIG. 2), not farther than the joint S. The through holes 142*b* extend through the agitating member 142 in a thickness direction. Each of the through holes 142*b* is located generally at a closed end of a corresponding one of the slits 142*a*. The closed ends of the slits 142*a* are longitudinally opposite ends of slit-open ends of the slits 142*a*. Because the through holes 142*b* in the toner agitating unit 14 allow toner to pass through the toner agitating unit 14 during agitation, a drag on the toner agitating unit 14 from the toner decreases. The through holes 142*b* are generally circular or elliptical to avoid stress concentration onto neighborhoods of the closed ends. The through holes 142*b* need not be necessarily circular or elliptical. That is, the through holes 142*b* can be polygonal with rounded corners as shown in FIG. 5 or 6. It is preferable that the through holes 142*b* have no sharp corners.

The length (D2 in FIG. 4, hereinafter "hole length") of the through holes 142*b* in the first direction is preferably from 1 millimeter to 5 millimeters. The length (D1, hereinafter, "hole width") of the through holes 142*b* in the longitudinal direction is preferably from 1 millimeter to 5 millimeters. If the hole length and/or the hole width is smaller than 1 millimeter, stress is likely to concentrate onto the through holes 142*b* during agitation. Moreover, when the hole length and/or the hole width is equal to or greater than 1 millimeter, production of a molding die for the agitating member 142 with the through holes 142*b* is facilitated. By setting the hole length and the hole width of the through holes 142*b* to be equal to or smaller than 5 millimeters, a drop in agitation efficiency can be avoided. When intervals between the through holes 142*b* in the longitudinal direction are small, strip-like portions between the slits 142*a* are deformed, causing a stress to concentrate on near-root portions, which are portions of the strip-like portions between the through holes 142*b*. Such stress concentration can result in plastic deformation.

Each of the through holes 142*b* is preferably located at a distance equal to or smaller than 5 millimeters (W1 in FIG. 4) from the joint S. The through hole 142*b* is preferably located at a distance (W1), from the joint S, equal to or smaller than 30% of a width (W2) of the first section F. When the through holes 142*b* are positioned in this manner, the maximum stress that could be applied to the near-root portions can be decreased. Accordingly, plastic deformation of the agitating member 142 can be prevented.

A slit interval (L in FIG. 4) between adjacent ones of the slits 142*a* is preferably from 3 millimeters to 20 millimeters. If the slit interval is smaller than 3 millimeters, it becomes difficult to form the through holes 142*b* in the first section F. Even if the through holes 142*b* are somehow formed, plastic deformation is likely to develop at the near-root portions due to stress applied during agitation. If the slit interval is greater than 20 millimeters, the rigidity of the toner agitating unit 14 increases, causing the rotary shaft 141 to receives a relatively large load from the toner agitating unit 14 during agitation. This can result in deformation of the rotary shaft 141.

Figure 7:
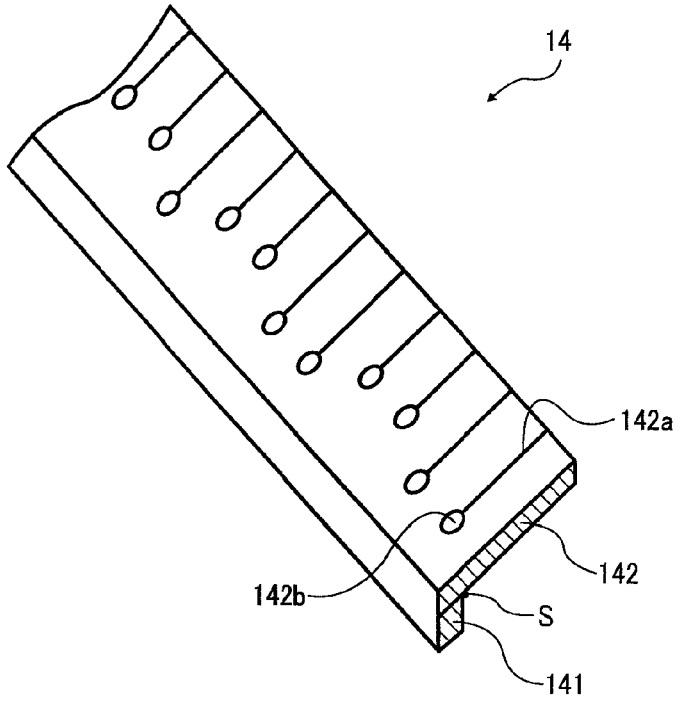
FIG. 7 is a schematic diagram of a third modification of the toner agitating unit shown in FIG. 4.
Figure 8:
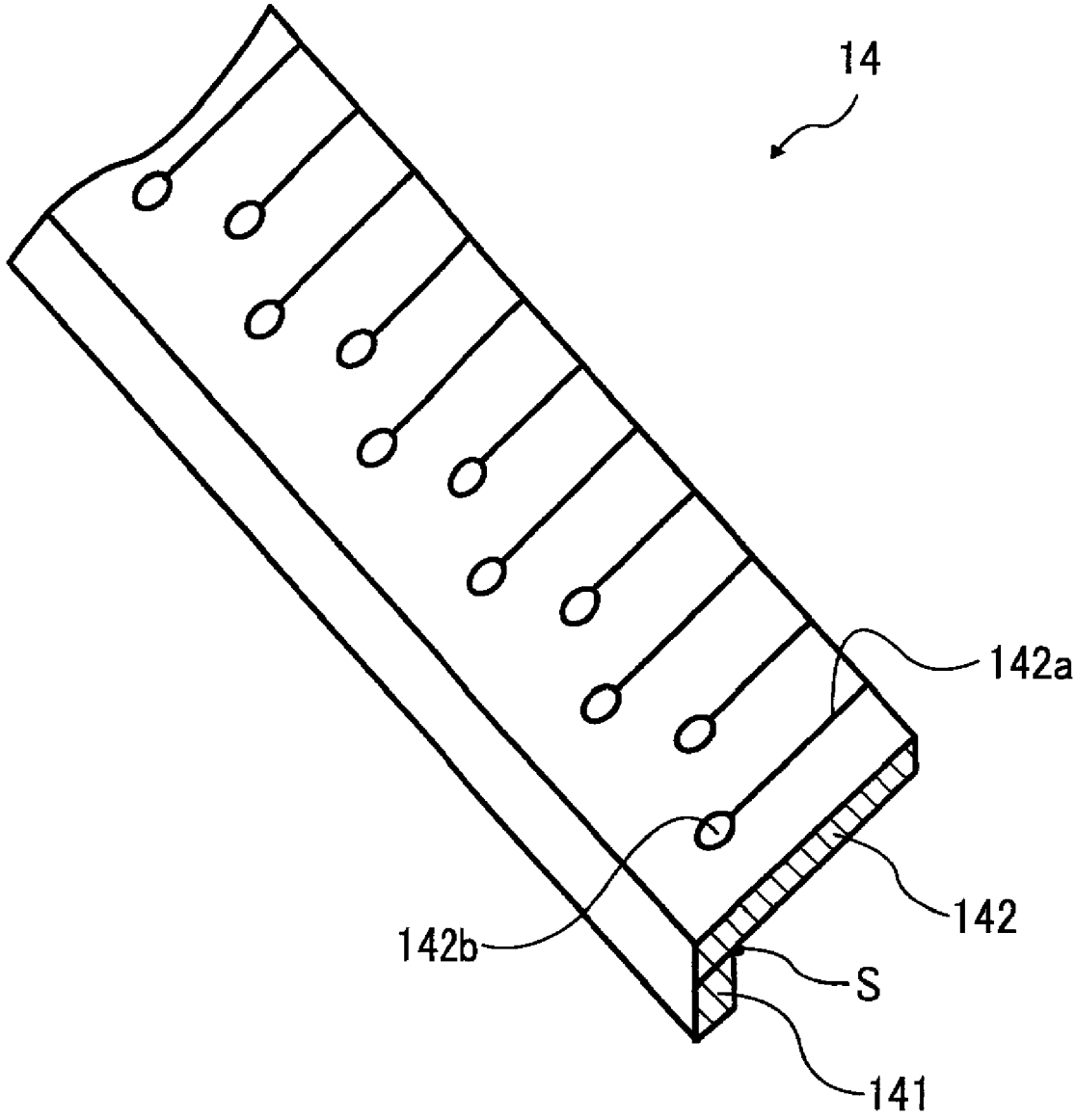
FIG. 8 is a schematic diagram of a fourth modification of the toner agitating unit shown in FIG. 4.

The distance of all the through holes 142*b* from the joint S need not be the same. That is, this distance can be varied depending on the longitudinal position of the through hole 142*b*, following predetermined cycles, as shown in FIGS. 7 and 8. This arrangement of the slits 142*a* makes it possible to secure a larger interval between the slit 142*a* and the through hole 142*b*, increasing the rigidity of the agitating member 142. The higher the rigidity of the agitating member 142 is, the larger the allowable size of the through holes 142*b* is. Hence, the degree of freedom in design is increased, and the agitating member 142 can have a generally optimal shape for agitation. Meanwhile, the toner hopper 13 includes a cylindrical housing 18 (see FIG. 9) that houses the toner agitating unit 14. During agitation, the agitating member 142 comes into contact with an inner wall of the housing 18 and presses the inner wall. When the toner agitating unit 14 is further rotated from this contacting state, the agitating member 142 goes away from the inner wall. Hence, when the through holes 142*b* are arranged as shown in FIG. 7, pivots of deformation (hereinafter, "deformation pivots") of the strip-like portions are generally in a staggered arrangement. When the deformation pivots are in such a manner, noises caused by separation of the agitating member 142 from the inner wall can be distributed over time.

Figure 9:
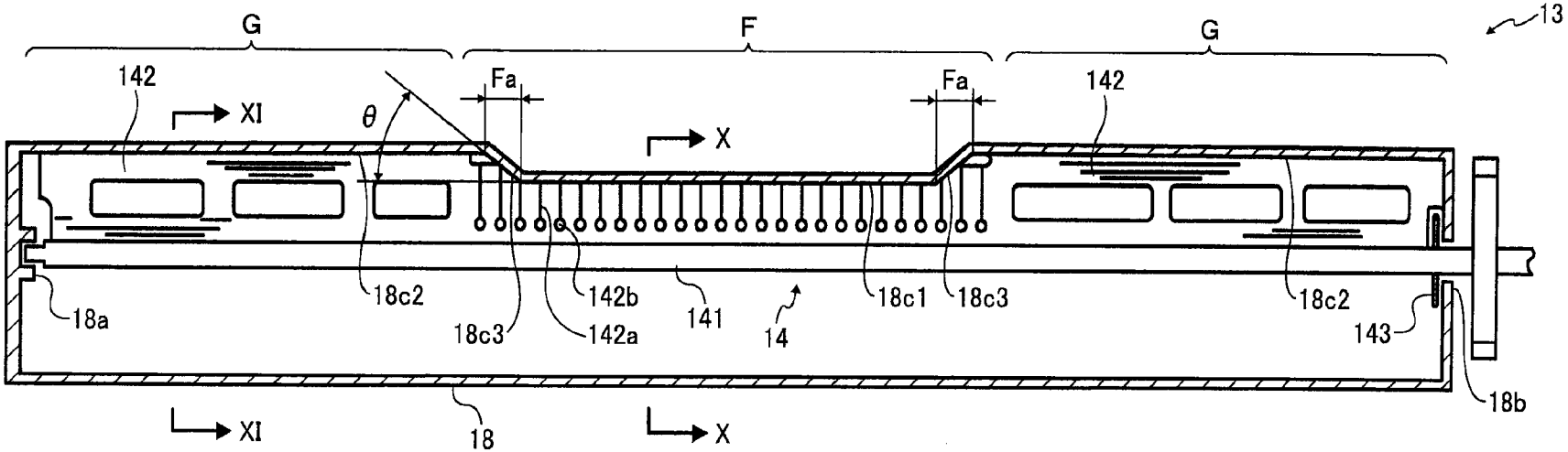
FIG. 9 is a schematic diagram for explaining a positional relationship between the toner agitating unit and a housing of a toner hopper.

FIG. 9 is a schematic diagram of a positional relationship between the toner agitating unit 14 and the housing 18. The housing 18 rotatably supports the toner agitating unit 14 via a bearing 18*a* and a bearing 18*b*. The bearing 18*a* is arranged at one longitudinal end of the housing 18 and the bearing 18*b* is arranged at the other longitudinal end. The toner agitating unit 14 includes the collar 143 for preventing unintentional detachment of the toner agitating unit 14 from the housing 18. The collar 143 comes into contact with the bearing 18*b* to limit longitudinal movement of the toner agitating unit 14. With this configuration, toner can be agitated by using the agitating member 142 across an entire longitudinal length of the housing 18.

Referring to FIG. 9, the first section F is in contact with a first wall portion 18*c*1 of an inner wall of the housing 18. The inner wall of the housing 18 also includes second wall portions 18*c*2. The second wall portions 18*c*2 are located to be more distant from the rotary shaft 141 than the first wall portion 18*c*1 is. The first wall portion 18*c*1 is placed between the second wall portions 18*c*2. In FIG. 9, the second section G is in contact with the second wall portions 18*c*2.

When the toner agitating unit 14 is configured in this manner, the toner agitating unit 14 comes into contact with a portion (on an upper side in FIG. 9) of the inner wall of the housing 18 across the housing 18 in the longitudinal direction. Hence, toner can be agitated thoroughly. While FIG. 9 shows an example configuration in which the first section F is in contact with the first wall portion 18*c*1 over the whole longitudinal length of the first section F, other configurations can be employed. For example, it is possible to employ a configuration in which only a part of the first section F comes into contact with the first wall portion 18*c*1 while the slits 142*a* located at opposite ends of the first section F come into contact with the second wall portions 18*c*2.

Figure 10:
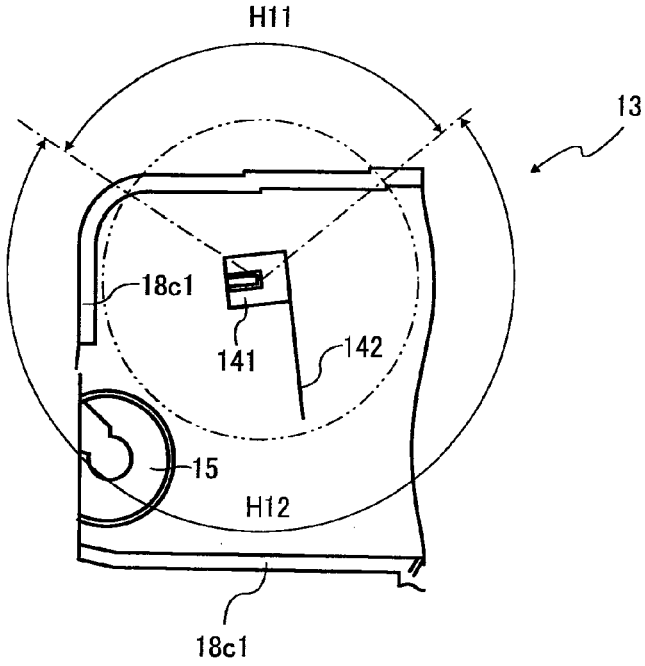
FIG. 10 is a schematic cross-sectional view taken along a line X-X of FIG. 9, depicting a rotating area of the toner agitating unit together with a first wall portion.

FIG. 10 is a schematic cross-sectional view of the toner hopper 13 taken along a line X-X of FIG. 9 to include the first wall portion 18*c*1 of the housing 18. A portion of the first wall portion 18*c*1 is positioned inside a rotating area (long dashed double-short dashed line) of the agitating member 142 of the toner agitating unit 14. The first wall portion 18*c*1 includes an area H11 and an area H12. While the agitating member 142 comes into contact with the first wall portion 18*c*1 in the area H11, the agitating member 142 keeps away from the first wall portion 18*c*1 in the area H12. The toner conveying screw 15 is arranged outside the rotating area of the agitating member 142.

Figure 11:
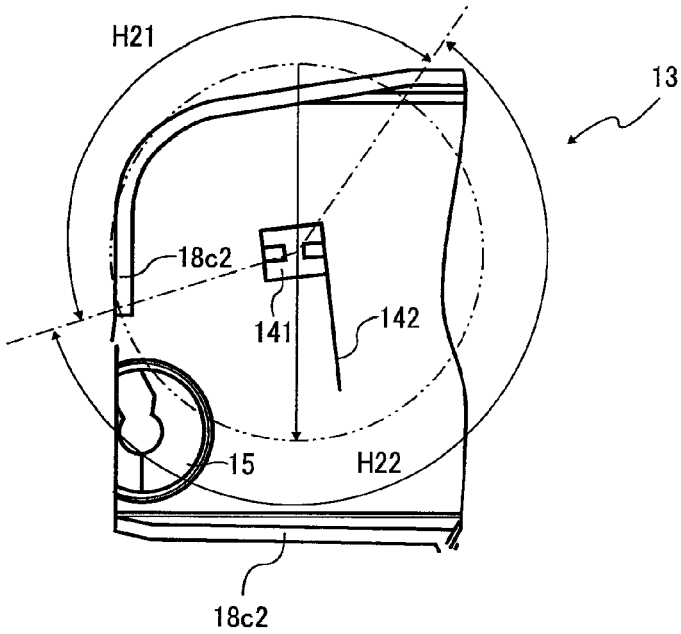
FIG. 11 is a schematic cross-sectional view taken along a line XI-XI of FIG. 9, depicting the rotating area of the toner agitating unit together with a second wall portion.

FIG. 11 is a schematic cross-sectional view of the toner hopper 13 taken along a line XI-XI of FIG. 9 to include one of the second wall portions 18*c*2 of the housing 18. The second wall portion 18*c*2 is positioned inside the rotating area (long dashed double-short dashed line) of the agitating member 142 of the toner agitating unit 14. The second wall portion 18*c*2 includes an area H21 and an area H22. While the agitating member 142 comes into contact with the second wall portion 18*c*2 in the area H21, the agitating member 142 keeps away from the second wall portion 18*c*2 in the area H22. The toner conveying screw 15 is arranged outside the rotating area of the agitating member 142.

Figure 12:
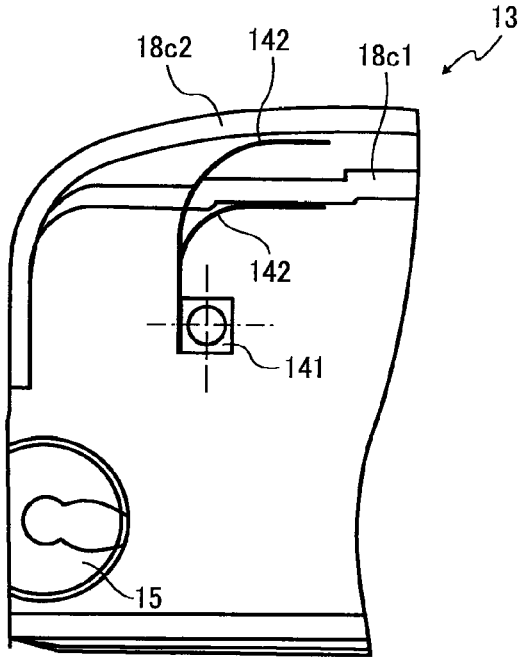
FIG. 12 is a schematic diagram of an agitating member of the toner agitating unit, with the agitating member contacting the first wall portion and the second wall portion.

When the toner agitating unit 14 is rotated from the position shown in FIGS. 10 and 11, the agitating member 142 comes into contact, at a slit-open edge of the agitating member 142, with the first wall portion 18*c*1 and the second wall portions 18*c*2. During abutting in this manner, the agitating member 142 is curved along the first wall portion 18*c*1 and the second wall portions 18*c*2, as shown in FIG. 12, in a direction opposite from the rotating direction of the toner agitating unit 14. Because the agitating member 142 has the slits 142*a*, the agitating member 142 comes into contact with both the first wall portion 18*c*1 and the second wall portions 18*c*2.

Figure 13:
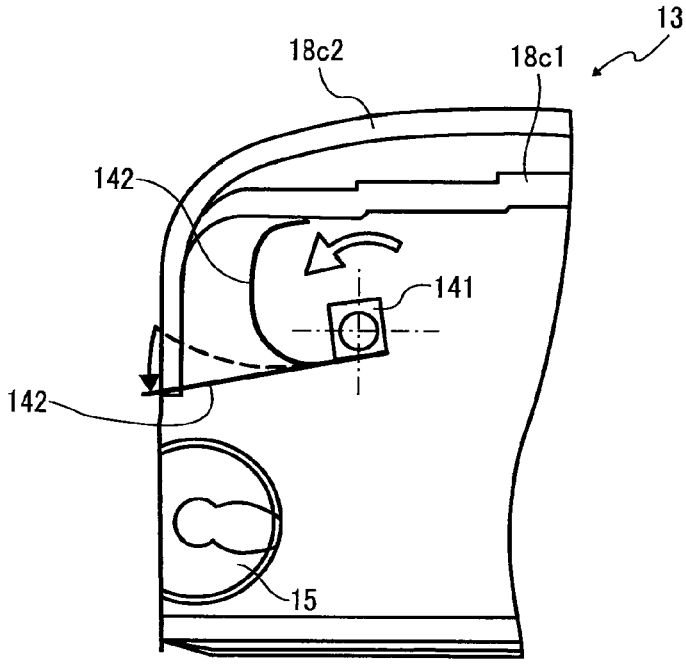
FIG. 13 is a schematic diagram of the agitating member, with the agitating member away from the first wall portion and in contact with the second wall portion.

When the toner agitating unit 14 is further rotated from the position shown in FIG. 12, portions of the agitating member 142 are released as shown in FIG. 13. More specifically, the portions (hereinafter, "first portions"), at which the agitating member 142 is in contact with the second wall portions 18*c*2, return to original, flat shape. The other portion (hereinafter, "second portion") of the agitating member 142 remains to be in contact with the first wall portion 18*c*1 and remains to be curved (see FIG. 13). In other words, the first section F with the slits 142*a* and the second section G without the slits 142*a* are released at different times from their contacting states. In the contacting state, the first section F, or the second section G, presses an inner surface of the toner hopper 13. Why the first section F and the second section G are separated from the inner surface at different times will be described below. The first section F with the slits 142*a* differs from the second section G without the slits 142*a* in rigidity, causing the first section F to differ from the second section G in sharpness of a curve resulting from a same degree of rotation of the rotary shaft 141. Accordingly, the first section F and the second G of the agitating member 142 are separated from the inner surface of the toner hopper 13 at different times, and noises caused by separation of the agitating member 142 from the inner surface can be distributed over time.

Because the first portions are released from the contacting state earlier than the second portion, toner held at the second section G of the agitating member 142 is caused to move toward the first section F in the longitudinal direction. Hence, toner agitation efficiency can be increased. It is possible to cause the second portion to be separated from the first wall portion 18*c*1 earlier than separation of the first portions from the second wall portions 18*c*2 by, for example, modifying the shapes of the agitating member 142 and the housing 18.

The larger the rotating area of the toner agitating unit 14 is, the higher the agitation efficiency of the toner agitating unit 14 is. Hence, when the housing 18 is assumed to have a plurality of surfaces at different distances from the rotary shaft 141 as shown in FIG. 9, the width W2 (see FIG. 4) of the agitating member 142 is typically determined based on a smallest distance of the distances from the surfaces to the rotary shaft 141. Why the width W2 is typically determined based on the smallest distance will be described below. A narrow portion of the agitating member 142, at which the width W2 is small, is rigid. Accordingly, a relatively large force is required to cause the narrow portion to slide on the inner surface of the housing 18; however, application of such a large force to the agitating member 142 can cause the agitating member 142 to be plastically deformed. To this end, the agitating member 142 according to the first embodiment includes the first section F, corresponding to the narrow portion, in which the plurality of slits 142*a* are arranged at regular intervals. Because a maximum stress to be applied to the toner agitating unit 14 is decreased by virtue of the slits 142*a*, the agitating member 142 is less easily plastically deformed.

The housing 18 has, in a portion corresponding to the first section F, a communication hole (not shown), through which toner can be conveyed to a unit (not shown), such as a toner storage unit and a housing unit that houses the developing roller 9. Because the agitating member 142 has the slits 142*a*, undesirable aggregation of toner to the periphery of the communication hole can be prevented.

A third wall portion 18*c*3 is placed between the first wall portion 18*c*1 and each of the second wall portions 18*c*2. The agitating member 142 has the slits 142*a* at a portion that is to come into contact with the third wall portion 18*c*3. This portion, shown in FIG. 9, is referred to as a section Fa. When the agitating member 142 includes the section Fa, even when the inner wall of the housing 18 and the agitating member 142 are not in good conformance to each other in terms of shape, toner near the third wall portion 18*c*3 can be agitated thoroughly by deformation of the sections Fa that have the slits 142*a*. With this arrangement, in a condition where the first portions are away from the second wall portions 18*c*2 and the first section F is in contact with the first wall portion 18*c*1, the sections Fa are released from a contacting state earlier than the remaining portion of the first section F. More specifically, the sections Fa are separated from the third wall portion 18*c*3 earlier than separation of the other portion of the first section F from the first wall portion 18*c*1. Accordingly, toner held by the second sections G is caused to move in the longitudinal direction toward the first section F, and toner agitation efficiency can be increased.

An angle θ between the third wall portion 18*c*3 and the rotary axis of the rotary shaft 141 is preferably from 30 degrees to 60 degrees, more preferably, 45 degrees. For this angle is smaller than 30 degrees, the capacity of the toner hopper 13 is undesirably small; and if this angle is greater than 60 degrees, an area of the inner wall, at which the agitating member 142 is not in contact with the toner hopper 13, is undesirably large.

Figure 14:
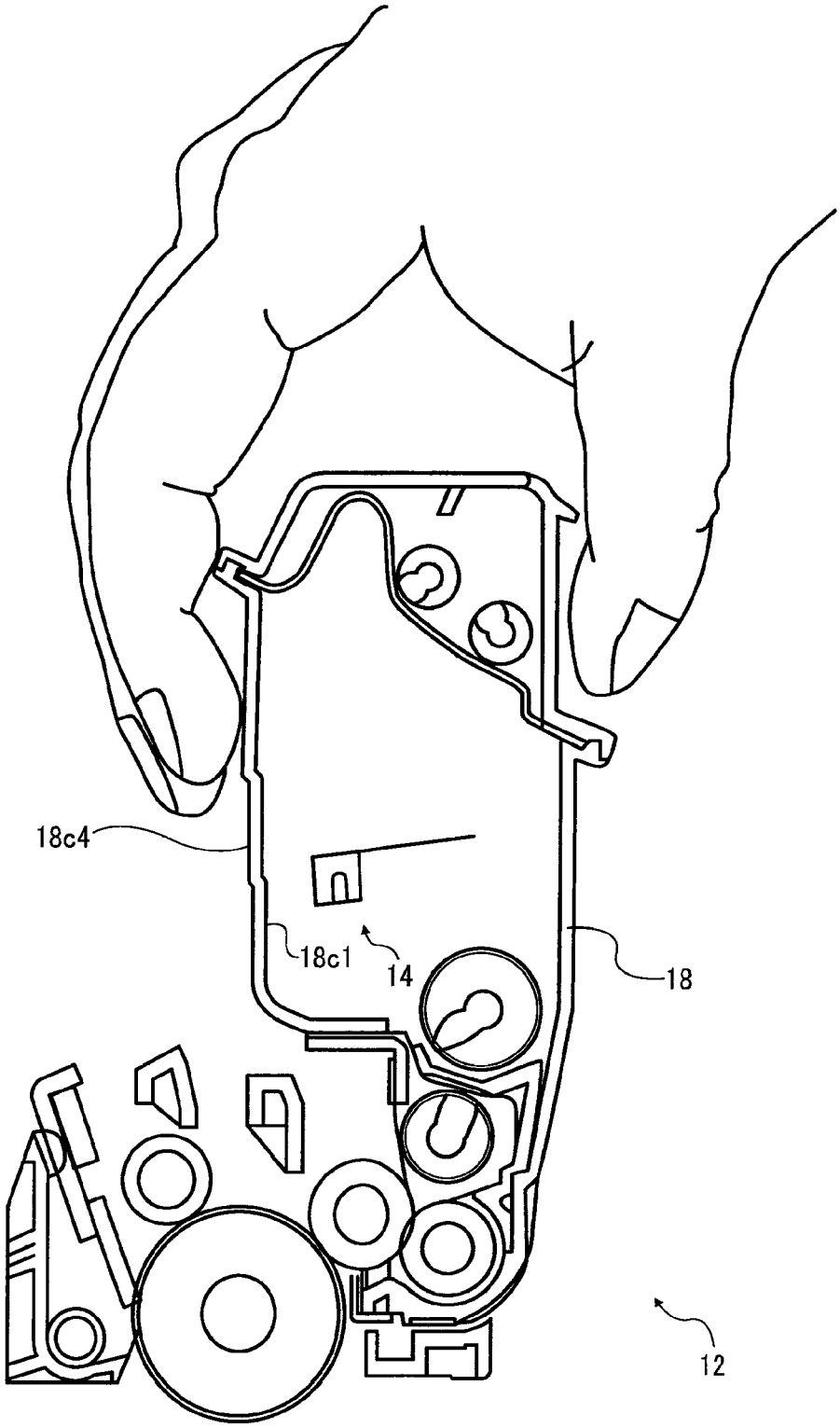
FIG. 14 is a schematic cross-sectional view of a process cartridge that includes a toner hopper shown in FIG. 2.
Figure 15:
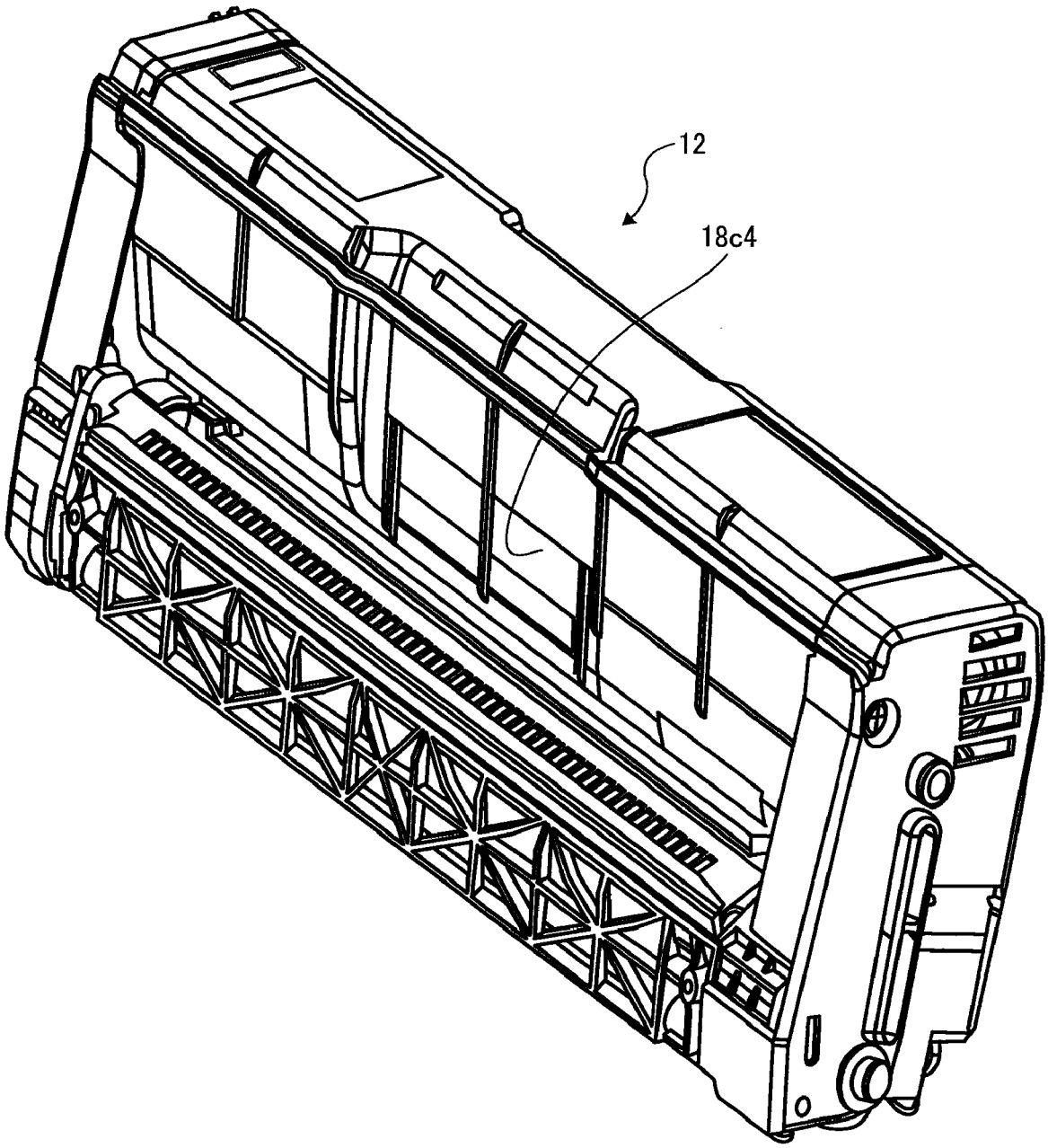
FIG. 15 is a perspective view of the process cartridge shown in FIG. 14.

FIGS. 14 and 15 are schematic diagrams of the process cartridge (developing unit 12) that includes the toner hopper 13 according to the first embodiment. FIG. 14 is a cross-sectional view of the process cartridge taken along the second direction at a position near the longitudinal center of the toner hopper 13. The housing 18 can further have a grip recess 18*c*4 in the same wall as that of the first wall portion 18*c*1 but on a face opposite from the face on which the first wall portion 18*c*1 is provided. The grip recess 18*c*4 is provided for easy carrying of the toner hopper 13 with a user's fingers. Because the second wall portion 18*c*2 (see FIG. 13) does not have such a grip recess, a sufficiently large toner capacity can be ensured. The grip recess 18*c*4 eliminates the need of an additional part such as a grip handle for carrying of the process cartridge.

According to the first embodiment, the agitating member 142 is a flat plate made of resin, and has the slits 142*a*. The slits 142*a* extend from the outer edge of the agitating member 142 toward the rotary shaft 141 and are positioned appropriately. Accordingly, stress concentration during agitation can be avoided. Consequently, plastic deformation of and development of a crack in the agitating member 142 are prevented and toner agitation efficiency is increased.

According to an aspect of the present invention, plastic deformation and damage of the agitating member can be prevented and toner agitation efficiency can be increased.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner hopper that houses toner to be used for developing a latent image, the toner hopper comprising:

a housing that houses the toner; and a toner agitating unit that is rotatably supported inside the housing and operative to agitate the toner in the housing, the toner agitating unit including a rotary shaft extending in a longitudinal direction; and an agitating member that is attached to the shaft and rotates with the shaft, wherein the agitating member is made of resin, and the agitating member has a plurality of slits extending from an outer edge of the agitating member toward the rotary shaft, wherein the toner agitating unit includes a first section with the slits and a second section without slits, and the first section is brought into contact with a first wall portion of a wall of the housing by rotation of the toner agitating unit, wherein the housing has a second wall portion at a position more distant from the rotary shaft than the first wall portion is, and wherein the second section is brought into contact with the second wall portion by rotation of the toner agitating unit.

2. The toner hopper according to claim 1, wherein separation of the first section from the first wall portion and separation of the second section from the second wall portion occur at different times.

3. The toner hopper according to claim 1, wherein the agitating member includes a third section with a slit defined therein, and the third section is brought into contact with a third wall portion placed between the first wall portion and the second wall portion by rotation of the toner agitating unit.

4. The toner hopper according to claim 1, wherein the first wall portion is placed between a first, second wall portion and a second, second wall portion.

5. The toner hopper according to claim 1, wherein the housing has a grip recess in the wall of the housing on a face opposite from the first wall portion.

6. A toner hopper that houses toner to be used for developing a latent image, the toner hopper comprising:

a housing that houses the toner; and a toner agitating unit that is rotatably supported inside the housing and operative to agitate the toner in the housing, the toner agitating unit including a rotary shaft extending in a longitudinal direction; and an agitating member that is attached to the shaft and rotates with the shaft, wherein the agitating member is made of resin, and the agitating member has a plurality of slits extending from an outer edge of the agitating member toward the rotary shaft, wherein the toner agitating unit includes a first section with the slits and a second section without slits, and the first section is brought into contact with a first wall portion of a wall of the housing by rotation of the toner agitating unit, wherein the housing has a second wall portion at a position more distant from the rotary shaft than the first wall portion is, wherein the agitating member includes a third section with a slit defined therein, and the third section is brought into contact with a third wall portion placed between the first wall portion and the second wall portion by rotation of the toner agitating unit, and wherein an angle between the third wall portion and the rotary shaft is from 30 degrees to 60 degrees.

7. The toner hopper according to claim 6, wherein an angle between the third wall portion and the rotary shaft is 45 degrees.

8. An image forming apparatus comprising a toner hopper that houses toner to be used for developing a latent image, the toner hopper including a housing that houses the toner; and a toner agitating unit that is rotatably supported inside the housing and operative to agitate the toner in the housing, the toner agitating unit including a rotary shaft extending in a longitudinal direction; and an agitating member that is attached to the shaft and rotates with the shaft, wherein the agitating member is made of resin, and the agitating member has a plurality of slits extending from an outer edge of the agitating member toward the rotary shat wherein the toner agitating unit includes a first section with the slits and a second section without slits, and the first section is brought into contact with a first wall portion of a wall of the housing by rotation of the toner agitating unit, wherein the housing has a second wall portion at a position more distant from the rotary shaft than the first wall portion is, and wherein the second section is brought into contact with the second wall portion by rotation of the toner agitating unit.

* * * * *